United States Patent [19]

Blakeman

[11] 4,103,362

[45] Aug. 1, 1978

[54] BILLIARD GLOVE

[76] Inventor: Carl E. Blakeman, 6001 Downey Ave., Long Beach, Calif. 90805

[21] Appl. No.: 730,445

[22] Filed: Oct. 7, 1976

[51] Int. Cl.[2] ..... A41D 19/00

[52] U.S. Cl. ..... 2/161 A

[58] Field of Search ..... 2/158, 159, 160, 161, 2/162, 163, 164, 165, 166, 167, 168, 169, 16, 21; 273/24

[56] References Cited

U.S. PATENT DOCUMENTS

| | | | |
|---|---|---|---|
| 1,362,461 | 12/1920 | Anast | 2/21 |
| 3,707,730 | 1/1973 | Slider | 2/161 A |

FOREIGN PATENT DOCUMENTS

| | | | |
|---|---|---|---|
| 485,301 | 5/1938 | United Kingdom | 2/168 |

*Primary Examiner*—Doris L. Troutman

*Attorney, Agent, or Firm*—Fulwider, Patton, Rieber, Lee & Utecht

[57] ABSTRACT

A glove is provided for the guide hand of a billiard player. The glove has a covering that envelopes the knuckle areas of the thumb, index finger and middle finger of the player's guide hand, leaving the ring finger and little finger free. To secure the glove in position, a releasably fastenable strap is provided in the vicinity of the wrist area of the guide hand.

7 Claims, 3 Drawing Figures

BILLIARD GLOVE

FIELD OF THE INVENTION

The present invention relates to a system for smoothing the longitudinal movement of a billiard cue relative to the guide hand of a billiard player and associated apparatus useful in such a system.

BACKGROUND OF THE INVENTION

It is presently the practice among billiard players in shooting with a billiard cue to support the cue with the hand used as a guide hand and to move the cue longitudinally with the other hand relative to the guide hand with a short jab or thrusting motion. The movement of the cue across the surface of the guide hand is extremely critical in achieving accuracy in shooting. It is quite important for this movement to be achieved with the least possible friction.

One system which has been developed to reduce friction in moving a billiard cue relative to the guide hand of a player involves the application of a dry lubricating powder to the fingers of the billiard player's guide hand. This dry lubricant is typically a white chalk powder and is applied from a container having a number of apertures through which the powder is dusted onto the hand of an individual. The powder is quite messy to use, however, and must be applied frequently throughout play. In addition, the powder, because of its nature and manner of application, falls to the surface of the billiard table and to the floor of the room in which the table is located. Moreover, as the billiard players move their hands past their clothing, the lubricating powder is picked up on the articles of clothing which they wear. Consequently, at the end of a session of billiards, the felt covering of the billiard table, the floor of the room in which the table is located, and the clothing of the participants are covered with the lubricating powder. Cleaning of each of the areas in which the lubricating powder is left is then necessary.

To properly clean the felt top of a billiard table, the felt must be brushed to remove dirt and powder left after a session of billiards. To remove the lubricating powder, the billiard table must be brushed particularly hard and for a particularly long period of time. Such hard brushing reduces the life of the felt covering on the table to a very significant extent. As a result, the conventional system for facilitating the movement of a billiard cue relative to the guide hand of a player entails marked shortcomings.

In the past, there have been attempts to develop gloves or other articles to aid in billiard shooting by reducing the friction of longitudinal sliding action of the billiard cue relative to the guide hand of the player. All of these devices have failed to gain acceptance among billiard players, however, because they have been difficient in one or more respects.

Accordingly, it is an object of the present invention to provide a system for smoothing the longitudinal movement of a billiard cue relative to the guide hand of an individual by providing a particularly useful article for wear on the player's guide hand.

A further object of the invention is to provide a glove or covering which may be worn on the guide hand of a billiard player and which includes a soft fabric covering for the entire knuckle areas of the thumb, index finger and middle finger of the guide hand. The glove leaves the ring finger and little finger completely free, however. Thus, the glove is readily adaptable to virtually any style of play. It provides a smooth surface for guiding the cue whether the player forms a bridge with the knuckles of his index and middle fingers, whether he passes the cue through a loop formed by his index finger relative to his thumb whether he shoots with the cue resting on the surface of his hand extending between his thumb and index finger, or whether he adopts some other style of billiard play. The covering apparatus of the present invention is equally applicable and useful with any style of shooting which the player adopts.

Another object of the invention is to provide an article as an aid in billiard shooting which may be conveniently and snugly worn on the guide hand of the player, but which is not difficult to put on or remove. To facilitate putting the gloove of the invention on and taking it off, a strap is provided which extends around the guide hand of the player and fastens in the player's wrist area. The glove is releasably fastenable to alternatively be held snugly in position on the player's hand, or to allow easy removal.

A further object of the invention is to provide a covering or glove adaptable to various styles of play as aforesaid, by leaving the ring finger and little finger completely free from the covering. Since the surfaces of these fingers are never used as guide surfaces, no useful purpose is achieved by covering them. Moreover, by leaving these fingers completely free, the player is allowed additional latitude and freedom of movement to use these fingers to form a base for resting his guide hand relative to the billiard table.

Another objective of the invention is to provide an aid for facilitating movement of a billiard cue relative to the guide hand of a player. This accessory may be worn as a glove rather than existing as a separate article used by a number of players and which must be continually sought and replaced. Each player ideally has his own billiard glove constructed according to the invention so that he becomes familiar and comfortable to the feel of a single article useful in serving as an aid in improving billiard shooting.

DESCRIPTION OF THE DRAWINGS

FIG. 1 is a view of the invention showing the back of a player's guide hand with the glove of the invention positioned there around.

DETAILED DESCRIPTION

Figure 2:
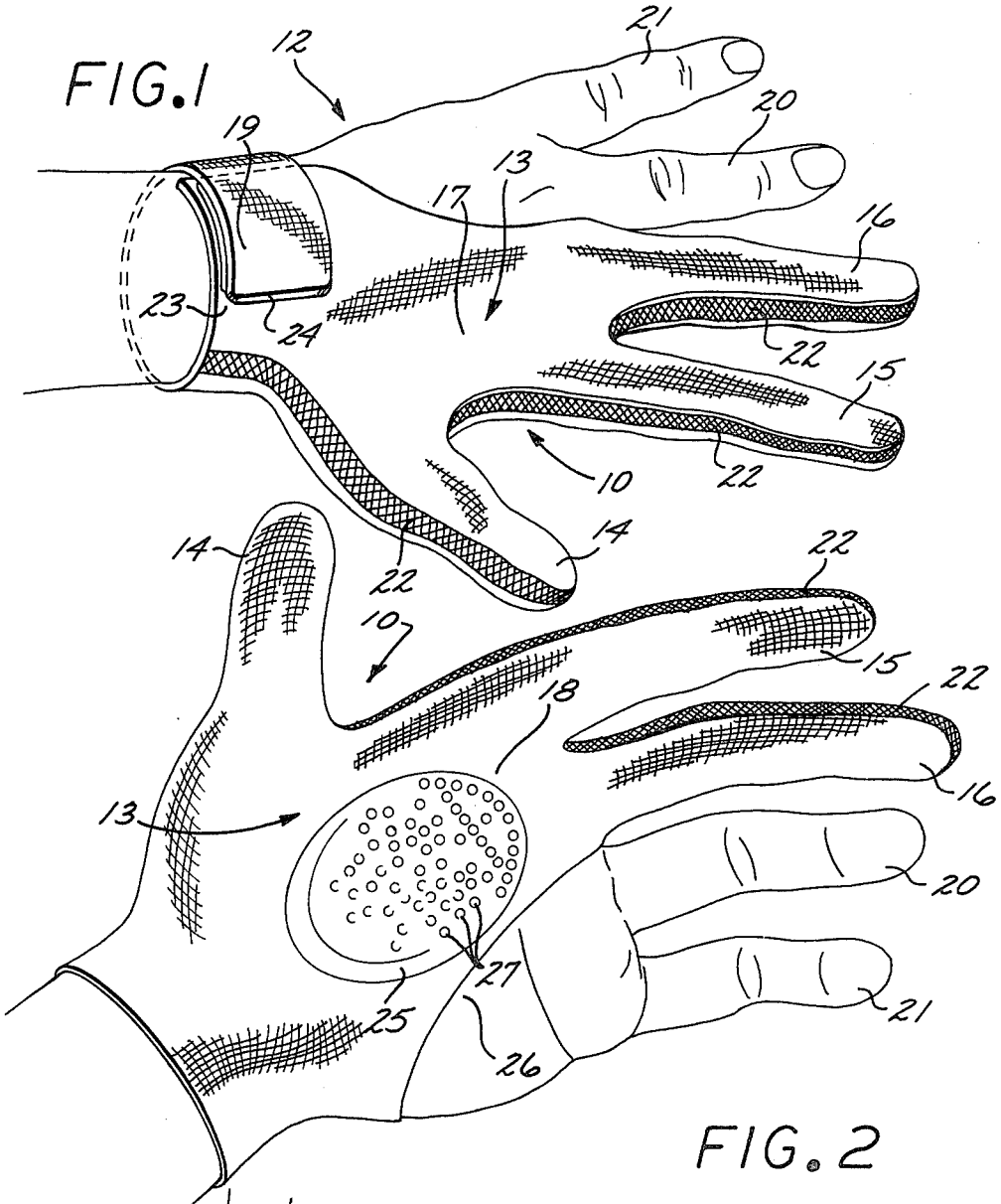
FIG. 2 is a view of the apparatus of the invention in position, illustrating the palm area of the player's hand.

An apparatus in the form of a glove 10 is provided for facilitating the sliding movement of a billiard cue 11 relative to the guide hand 12 of a billiard player. The apparatus comprises a covering 13 formed to encompass the knuckles of the thumb 14, the index finger 15, and the middle finger 16 of the guide hand 12. The cover 13 encircles the guide hand by extending around the outside edge of the guide hand 12. The covering 13 has surfaces 17 and 18 constructed of soft fabric, preferably polyester terrycloth or double stretch polyester. The covering 13 includes a releasable fastening strap 19. The ring finger 20 and little finger 21 of the guide hand protrude freely from the covering 13.

Preferably, an as indicated, the covering 13 envelopes entirely the thumb 14, index finger 15 and middle finger 16 of the guide hand 12. An elastic mesh is provided and is sewn to the terrycloth fabric and joins the soft fabric expansive surfaces 17 of the covering 13 along the edges of the thumb 14, index finger 15 and middle finger 16. Preferably the elastic mesh is nylon stretch material. This allows the glove 10 to be worn snugly on the guide hand 12 and also provides ventilation so that the player's guide hand 12 does not become unduly warm or uncomfortable by virtue of accumulated perspiration.

On the outer surface of the covering 13 adjacent to the wrist of the guide hand 12, as indicated at 23, a velcro pad is provided. Similarly, another velcro pad is provided on the innersurface of the fastening strap 19. In this manner the velcro pads may be positioned in contact with each other, as indicated at 24, to hold the covering 13 in position on the guide hand 12. While an elastic band can be sewn into the covering 13 to encircle the player's hand 12 or to run across the back of the guide hand from the wrist to the knuckle of the middle finger 16 to hold the covering snugly about the wrist, this is not always necessary.

Positioning is further aided by the elastic mesh material 22 that joins the soft fabric surfaces 17 of the covering 13 along the edges of the thumb 14, index finger 15 and middle finger 16. The material 22 likewise is sewn to the covering material 13.

The covering 13 includes an opening in one of the terrycloth surfaces 17 into which a perforated laminar leather insert piece 25 is secured for positioning adjacent to the center of the palm 26 of the guide hand 12. The leather insert 25 includes perforations 27 that allow perspiration on the player's palm 26 to evaporate.

Figure 3:
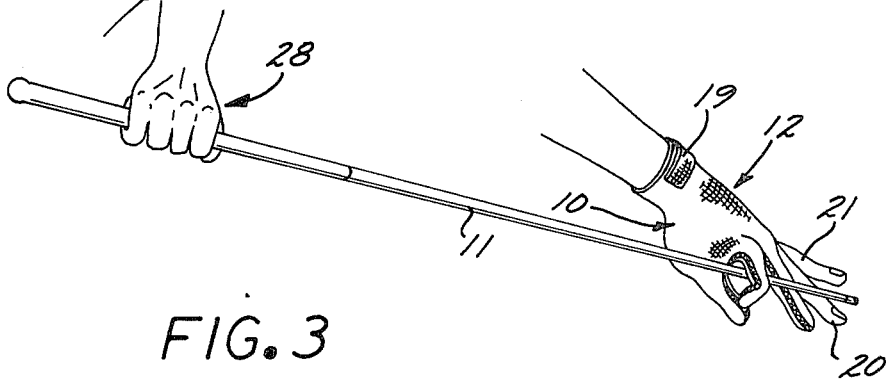
FIG. 3 illustrates the hands of a billiard player in position for effecting a shot employing the apparatus of the invention.

In utilizing the glove 10 before smoothing the longitudinal movement of a billiard cue 11 relative to the guide hand 12 of a billiard player, the player grasps the weighted end of the cue with his other hand 28. He then positions his guide hand 12 with his cue resting on a surface of the billiard table 10 that includes the smooth fabric terrycloth surfaces 17 that encompass the knuckles of the thumb, index finger and middle finger as aforesaid. The player then effects longitudinal movement of the billiard cue 11 relative to his guide hand 12 by bringing his other hand 28 sharply forward toward his guide hand 12. The cue moves smoothly across the surfaces of the billiard glove hand 10 and does not catch or bind as it might in moving across the uncovered fingers of the player's guide hand. It can be seen in FIG. 3 that the ring finger 20 and little finger 21 of the guide hand 12 are entirely free from the glove 10 and thus may be easily manipulated to form the necessary shooting base relative to the surface of the billiard table.

While but a single embodiment of the invention has been depicted, the invention should not be considered as limiting, for various alterations and modifications of the invention will become readily apparent to those familiar with billiard play. The glove 10 of the invention is adaptable for either table or pocket billiards. The glove 10 depicted in the diagrams is designed for use on the left hand of an individual, although it should be understood that a corresponding glove should be provided for a player's right hand where he uses his right hand as the guide hand in billiard shooting. Alternatively, the glove of this invention could be constructed to have universal application in that it would be reversible and capable of being worn on either hand.

While the billiard glove of the construction described in the embodiment depicted is designed for reuse, an alternative form of construction involves the provision of a disposable glove. One form of disposable glove is a glove constructed of flexible paper having a smooth outer surface. Such a glove could be sold from vending machines and would normally be discarded following a session of billiards. In this embodiment, the wrist strap would operate using a cinching arrangement whereby the strap would be passed through an opposing loop and winched snugly about the player's guide hand.

I claim:

1. An apparatus for facilitating the sliding movement of a billiard cue relative to the guide hand of a billiard player comprising a covering formed to encompass the knuckles of the thumb, index finger and middle finger of said guide hand and to encircle said guide hand and having expansive surfaces constructed to soft, porous fabric to reduce friction with respect to a billiard cue sliding thereover and including a releasable fastening strap and wherein the ring finger and little finger of said guide hand protrude freely from said covering.

2. The apparatus of claim 1 further characterized in that said covering entirely envelopes said thumb, index finger and middle finger.

3. The apparatus of claim 1 further characterized in that said soft fabric is polyester terrycloth.

4. The apparatus of claim 1 further characterized in that a velcro pad is provided on the outer surface of a said covering adjacent to the wrist of said guide hand, and a velcro pad is provided on the inner surface of said fastening strap, whereby said velcro pads may be positioned in contact with each other to hold said covering in position on said guide hand.

5. The apparatus of claim 1 further characterized in that an elastic mesh material joins soft fabric expansive surfaces of said covering along the edges of said thumb, index finger and middle finger.

6. The apparatus of claim 1 further characterized in that said covering includes an opening in one of said surfaces into which a perforated laminar leather insert piece is secured for positioning adjacent to the center of the palm of said guide hand.

7. A method for smoothing the longitudinal movement of a billiard cue relative to the guide hand of a billiard player comprising providing the guide hand of a billiard player with a covering at least partially constructed of smooth, porous fabric surfaces to reduce friction against a billiard cue sliding thereover and formed to encompass the knuckles of the thumb, index finger and middle finger of said guide hand and secured in position by a strap releasably fastened at the wrist of said guide hand, guiding said billiard cue by positioning it in contact with said covering, and effecting longitudinal movement of said billiard cue relative to said guide hand.

* * * * *